US007021177B2

(12) United States Patent
Lövemark et al.

(10) Patent No.: US 7,021,177 B2
(45) Date of Patent: Apr. 4, 2006

(54) HAND TOOL

(75) Inventors: Mattias Lövemark, Västerås (SE); Jan Ol-Lars, Järfälla (SE)

(73) Assignee: Kapman AB, Sandviken (SE)

( * ) Notice: Subject to any disclaimer, the term of this patent is extended or adjusted under 35 U.S.C. 154(b) by 0 days.

(21) Appl. No.: 10/962,438

(22) Filed: Oct. 13, 2004

(65) Prior Publication Data

US 2005/0160884 A1 Jul. 28, 2005

(30) Foreign Application Priority Data

Oct. 15, 2003 (SE) ..... 0302724

(51) Int. Cl.
*B25B 7/02* (2006.01)

(52) U.S. Cl. ..... 81/417; 81/427.5

(58) Field of Classification Search ..... 81/417, 81/427, 427.5

See application file for complete search history.

(56) References Cited

U.S. PATENT DOCUMENTS

| | | | | |
|---|---|---|---|---|
| 2,028,558 A | | 1/1936 | Nietzel et al. | |
| 2,123,357 A | * | 7/1938 | Grah et al. | 30/28 |
| 3,261,244 A | * | 7/1966 | Smoyak et al. | 81/417 |
| 5,619,892 A | | 4/1997 | Eggert | |

FOREIGN PATENT DOCUMENTS

| | | |
|---|---|---|
| DE | 49 336 | 4/1889 |
| SE | 506 068 | 11/1997 |

* cited by examiner

*Primary Examiner*—David B. Thomas
(74) *Attorney, Agent, or Firm*—Buchanan Ingersoll PC

(57) ABSTRACT

The invention relates to a hand tool comprising a first leg (1) and a second leg (2) whereby a front part of the respective leg creates a tool part (3 and 4 respectively) and a rear part of the respective leg creates a gripping part (5 and 6 respectively). The gripping part (5) of at least one of the legs comprises an outer part in the form of a sleeve (10) which is fitted over an inner part (9) connected with the tool part (3). Further the hand tool comprises at least one spring part (12) with a first freely moveable end part (13) and a second end part firmly held at the mentioned sleeve (10). This spring part (12) is intended to again move the legs (1, 2) apart after they have been squeezed together in using the tool. According to the invention the mentioned sleeve (10) of one of the mentioned legs is executed with guides (16, 17, 18) for at least two positions for the spring part (12), of which a first guide (16) defines the first position which is an inactive position for the spring part (12) where it does not exert any separating force upon the legs (1, 2) in use and a second guide (17, 18) defining a second position which is an active position for the spring part (12), where it exerts a separating force upon the legs (1, 2) in use as a result of the first free end part (13) of the spring part coming into abutment with the opposite leg.

8 Claims, 3 Drawing Sheets

HAND TOOL

TECHNICAL AREA

The present invention concerns a hand tool with two legs in accordance with the preamble of the patent claim 1. More particularly, the invention concerns different kinds of pliers, but also other types of hand tools are conceivable.

BACKGROUND OF THE INVENTION

Hand tools, such as for example pliers, sheet-metal shears and pruning shears that are provided with a so called return spring between the two legs of the tool handle are previously known. This return spring functions in such a way that when the two legs are squeezed together in using the pliers the mentioned spring will exert a leg separating force, and the legs will therefore be re-opened to a given angle as soon as the squeezing force ceases. The return spring may be a helical spring or different types of leaf spring.

It has been found, however, that many users do not at all want the return spring function. This may be due to old habits; one is simply used to a tool without a return spring and then it is considered impractical or uncomfortable with a return spring. Then the user often removes the return spring from the tool and it can usually not be mounted back again. In other cases it may be such that the return spring function is in itself wanted but one believes that it is impractical to place the tool in one's pocket or tool box with the legs splayed apart and where the legs easily hook up with other tools making it difficult to take the tool up again or to take other tools up from the box.

Thus, it has been found a need for the user to be able to influence the return spring function. The return spring function should be possible to "shut off" in an easy way, for instance when the tool is to be placed in the pocket, and then the function is to be just as easily activated again when the tool is to be used.

It is previously known a pliers which, when it is packaged for sale, has a return spring pressed up in a locked state where the spring does not carry out any spring return function. The pliers in question have two legs forming gripping parts and which are provided with sleeves that are fitted to the legs from the rear, i.e. from the free ends of the legs. The forwardly open end of one sleeve has on its inside a space which is used for firmly holding of the return spring. This return spring has a second end which is freely movable and which normally in use abuts and slides against the opposing leg and thus forces the legs apart. When the pliers are packaged for sale the return spring is however compressed so that its free end abuts the edge of the leg in which said second end is fastened, which edge is turned towards the opposing leg. The free end is thus not free in this inactive position but is held firmly by friction. In order to create a movement of the spring from the active position to the inactive position a relatively large force must be executed upon the spring in that the free end of the spring must be bent downwards and sideways. To move the spring from the active position to the inactive position and vice versa is therefore not anything that the user normally does. Besides, it is definitely not anything that the user would think of doing every time the tool is to be put into the pocket. It is much too troublesome and time consuming. Thus, when the pliers have been removed from its packaging and the return spring has been activated it will probably never be returned to the locked position again. Moreover, the free end of the spring is executed in a special way with a hook in order to create a sufficient bending out of the spring such that it may be locked against the edge of the leg.

There are also types of tools and pliers for which it has been difficult to find a good solution with a return spring. This is true for for instance pliers or other tools with a so called closed joint. Distinct from an open joint, i.e. a sissors type joint where the legs have the same thickness or height behind the joint, where the handle part begins, as in the joint itself, the legs forming the handle of a closed joint have twice the thickness right up to the point at which they intersect one another and where they may have just a single thickness. The double thickness means that there is no free space available between the legs up at the joint. To this point a return spring in the form of a helical spring has been used in some cases which spring is mounted further down between the legs. This spring, however, encroaches on the space for the fingers of the holding hand and there is for instance a risk for pinching the fingers. Furthermore, the helical springs have the drawback that they easily cease-up or break-off.

OBJECT OF THE INVENTION

The object of the present invention is to provide a solution to the aforesaid problems and thus suggest an improved hand tool of the described kind.

SUMMARY OF THE INVENTION

The above object is achieved by means of the present invention as defined in the independent patent claim 1. Appropriate embodiments of the invention are apparent from the dependent patent claims.

Thus there is defined according to the present invention a hand tool comprising (including) a first leg and a second leg whereby a front part of the respective leg forms a tool part and a rear part of the respective leg forms a gripping part wherein the gripping part of at least one of the legs comprises an outer part in the form of a sleeve that is fitted over an inner part connected with the tool part and further comprising at least one spring part with a first freely movable end part and a second end part firmly held at said sleeve, which spring part is intended to again move the legs apart after they have been squeezed together when using the tool, characterized in that the mentioned sleeve of one of said legs is formed with guides for at least two positions for the spring part, of which a first guide defines a first position which is an inactive position for the spring part, where it does not exert any separating force upon the legs in use, and a second guide defines a second position which is an active position for the spring part in which it exerts a separating force upon the legs in use in that the first free end part of the spring part comes into abutment with the opposing leg.

According to the invention there is obtained the advantage that one and the same tool may be used both with and without a return spring function. By the guides secure and distinct positions for the spring are created. It is extremely simple to, preferably with the aid of the hand's thumb, move the spring between the mentioned guides from the active position to the inactive position and vice versa. A user which is not at all interested in the return spring function may easily deactivate the spring. A user which just occasionally wants to deactivate the spring function may easily and hastily do this, for instance when the tool is to be put down into a pocket or a tool box. Then it is just as simple to activate the spring function again when the tool is picked up in order to be used. According to the invention the possibility is thus provided to combine the advantages with a tool equipped with a return spring function which among other things provides ergonomic benefits such as reduced load on the hand and enhanced speed in using the tool, with the advantage of more practical handling of the tool due to the fact that the spring function may be deactivated when the tool is to be put away. No spread legs present a problem but the tool may be handled and kept with the legs conveniently closed together.

According to a second embodiment the sleeve may be executed with guides for two or more active positions for the spring part where the spring part exerts a separating force upon the legs in use and the spring part may be moved between these active positions in order to change the maximum opening angle between the legs with the aid of the spring part. This provides the advantage of enabling the tool to be adapted to an opening angle decided by the user.

Advantageously the mentioned guides are located on the inside of the sleeve facing the inner part of the gripping part. In this way the guides are well protected at the same time as the spring may easily be manoeuvred between the different positions between the legs. The respective guide is advantageously formed as a grove on the inside of the sleeve and the different positions of the spring part are defined by abutment in the different grooves.

According to a variant the spring part may be detachably held at said sleeve. It may then be readily replaced should the need arise. According to another variant the spring part may be unreleasably held at said sleeve.

According to a third variant the spring part may be executed in one piece with the mentioned sleeve.

According to further features the invention is characterized in that the leg that is opposite to the leg provided with the sleeve including said guides comprises a recess in which the free end part of the spring part is able to move freely when the spring part is in its inactive position in the sleeve. Such an embodiment provides the advantage that this type of return spring solution also may be used with tools with a closed joint, since with the aid of the mentioned recess a space for movement of the spring is provided.

BRIEF DESCRIPTION OF THE DRAWINGS

The invention will now be described more in detail with reference to exemplifying embodiments and with reference to the accompanying drawings, in which.

DETAILED DESCRIPTION OF THE INVENTION

Figure 6:
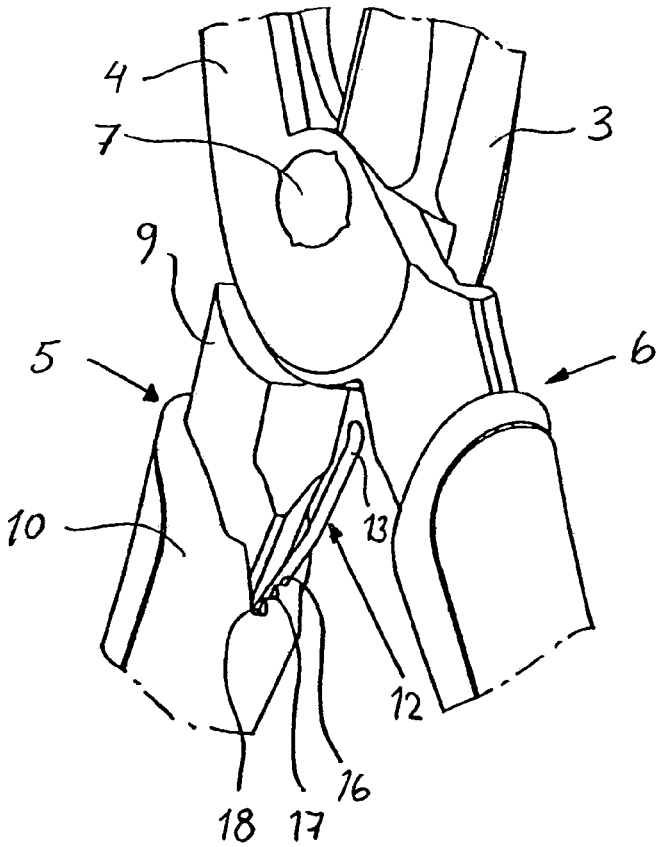
FIG. 6 shows a perspective view, in enlargement, of a second embodiment of the present invention.

In the FIGS. 1–5 a first embodiment of the present invention is shown applied to a hand tool in the form of a so called kombi-pliers. It is emphasized directly, however, that the invention is in no way limited to this type of pliers or to pliers as such but can be applied to any type of hand tool that includes two legs. Neither is it necessary for the legs to intersect but also feasible with for instance parallel legs. The same thing applies to the second embodiment which is shown in FIG. 6. Further with regard to the two illustrated embodiments those parts that are mutually the same or that correspond to each other have been given the same reference numerals.

The tool in the figures comprises a first leg 1 and a second leg 2. The front part of the respective leg 1, 2 forms a tool part 3 and 4 respectively and the rear part of the respective leg 1, 2 forms a handle part or gripping part 5 and 6 respectively. The legs 1, 2 are joined by a joint 7 and the tool part 3, 4 of the respective leg 1, 2 is located forwardly of the joint 7 whereas the gripping part 5, 6 of the respective leg 1, 2 is located rearwardly of the joint 7. The gripping part 5 of at least one of the legs is so constructed as to comprise an outer part in the form of a sleeve 10 which is fitted over an inner part 9 connected with the tool part 3. In the cases illustrated both the gripping parts are constructed in this way but it is fully conceivable to have only one gripping part provided with a sleeve. This sleeve is usually made of some type of plastic material or some other suitable material that will provide the user with a comfortable, secure and functional grip.

Figure 3A:
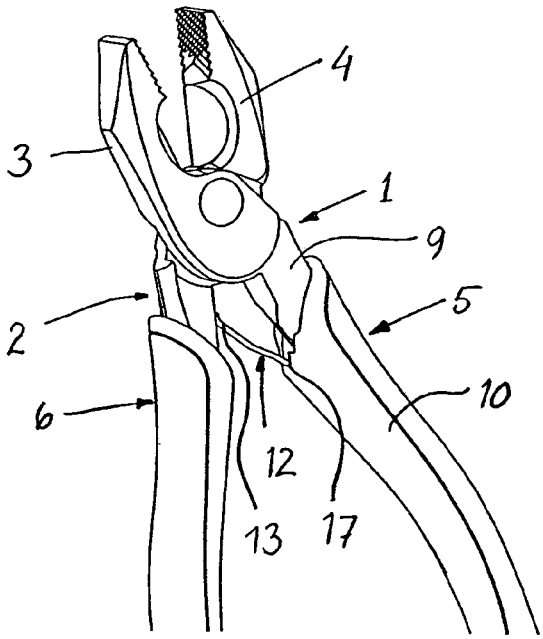
FIG. 3*a* shows a perspective view of a first embodiment of the present invention with the spring in an active position and the legs open.
Figure 3B:
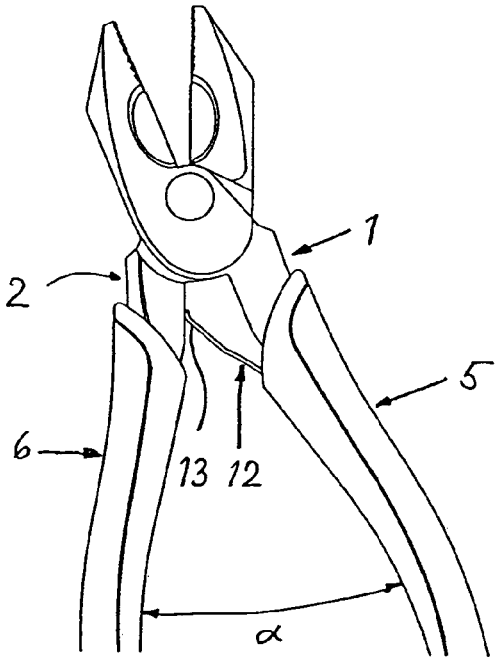
FIG. 3*b* shows a view from above of a first embodiment of the present invention with the spring in an active position and the legs open.
Figure 4:
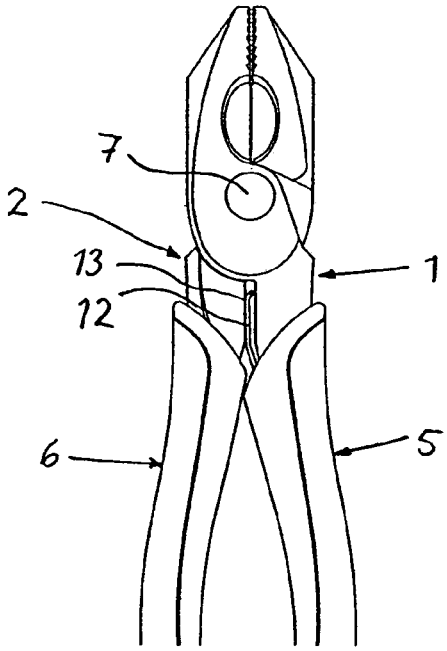
FIG. 4 shows a view from above of a first embodiment of the present invention with the spring in an active position and the legs closed.
Figure 5:
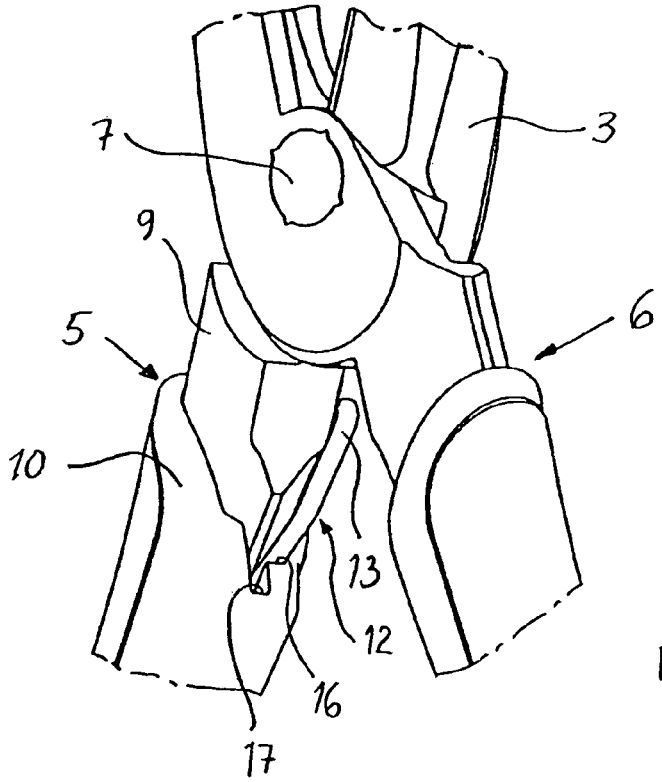
FIG. 5 shows a perspective view, in enlargement, of a first embodiment of the present invention

The tool further comprises a spring part 12 whose one end part is firmly held in the sleeve 10 of either the gripping part 5 or the gripping part 6 and in the illustrated cases the gripping part 5 of the leg 1. This spring part 12 has a second end part 13 which projects out between the legs 1, 2 behind the joint 7. The second end part 13 of the spring part is arranged in such a way that when the legs are squeezed together the end part 13 of the spring will come to abutment with the side of the opposed leg 2 and then exerts a separating force upon the legs. This is denoted return spring function as earlier described. FIG. 4 shows how the spring 12 is squeezed between the legs 1, 2 when these, or more correctly the gripping parts 5, 6 of these, are subjected to a leg-closing force by for instance a hand. FIGS. 3*a* and 3*b* show how the spring 12 acts on the legs 1, 2 when the squeezing together force ceases so that the legs are once again separated with the aid of the spring force. The maximum angle between the legs 1, 2 that the spring 12 results in when no force acts upon the spring is the so called opening angle $\alpha$.

Figure 1:
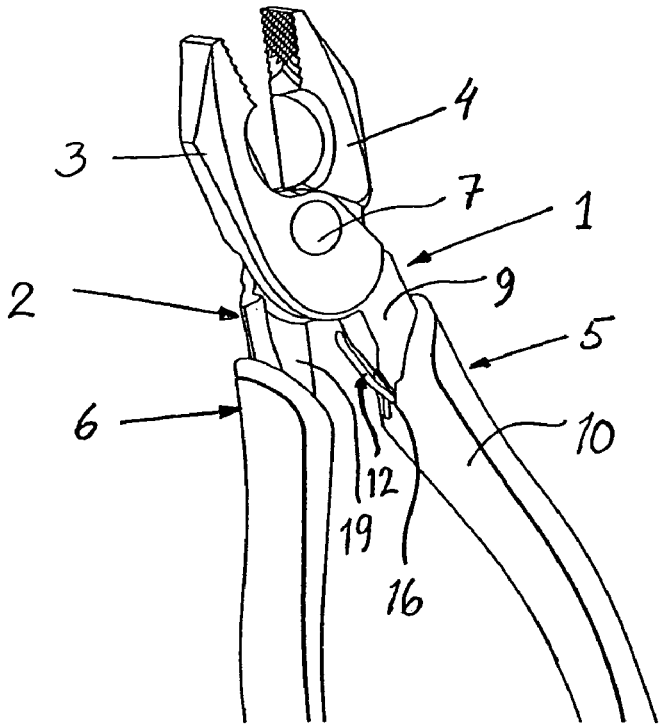
FIG. 1 shows a perspective view of a first embodiment of the present invention with the spring in an inactive position and the legs open.
Figure 2:
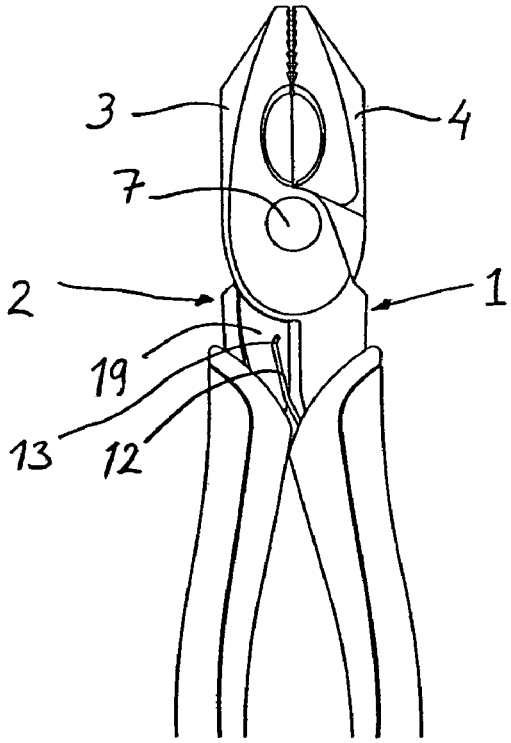
FIG. 2 shows a view from above of a first embodiment of the present invention with the spring in an inactive position and legs closed.

According to the present invention the spring is able to take an active position and an inactive position. This can be achieved by providing the sleeve according to the first embodiment illustrated in FIGS. 1–5 with guides 16, 17 that define two spring positions. As will clearly be seen from the enlarged view of FIG. 5 the first guide 16 defines a first inactive position for the spring 12. The second guide 17 defines a second position for the spring 12 which is an active position. The inactive position is also illustrated in FIGS. 1 and 2, where the guide 16 and the placement of the spring in the inactive position is especially evident from FIG. 1. The active position is also illustrated in FIGS. 3*a*, 3*b* and 4, where the guide 17 will be especially evident from FIG. 3*a*.

The two guides 16 and 17 are, according to the first embodiment, executed as two grooves provided on the inside of the sleeve 10, i.e. the inner surface facing the inner part 9 of the gripping part. The two positions for the spring 12 are obtained by abutment of the spring 12 with the bottom of the mentioned grooves and the spring may be easily moved between the mentioned guides/grooves by displacement of the spring sideways or as an alternative sideways and vertically with the aid of for instance the thumb of the user.

As is evident from FIG. 4 the space between the legs 1, 2 immediately behind the joint 7 is very restricted. In order to provide room for the spring 12 in an inactive position the opposing leg 2 has been provided with a recess 19 in that part of the leg that is located immediately behind the joint 7. This is illustrated in FIG. 2 where it is evident that the spring 12 with its free end 13 enters the recess 19 and therefore does not lie so that a spring force will be exerted. It is pointed out, however, that the arrangement of a recess 19 in itself is not a condition for functioning of the invention. It is for instance possible to adapt the guide for the inactive position and the spring mutually so that the free end of the spring, in the inactive position, is so close to its own leg that any extra space is not needed at the opposing leg. In the case of other types of joints it may possibly be so that sufficient space is found naturally for the free end of the spring part in the inactive position without the need to provide any recess.

In FIG. 6 it is illustrated a second embodiment of the present invention and in enlargement. According to this embodiment the sleeve has three guides 16, 17, 18 that each defines a position for the spring 12 by abutment in the grooves that form the guides. Of these positions the first position, determined by the first guide 16, is an inactive position. In FIG. 6 the spring 12 is in this position. The next position, the second position defined by the second guide 17, is an active position that gives a certain opening angle between the legs 1, 2. The third position, defined by the guide 18, is a further active position for the spring 12 that gives another, larger opening angle compared to the guide 17. In the same way as above the spring 12 may easily be moved between the different positions by a movement sideways, or as an alternative upwards and sideways, which movement may for instance be executed with the aid of the thumb of the user. In this way it is possible to arrange different opening angles for the pliers in addition to the return spring function being able to be deactivated.

In the illustrated examples the spring 12 will in the active position get in abutment with the inner part of the gripping part which is in connection with the tool part 3. There is, however, nothing to prevent the spring from coming into abutment with the outer part in the form of a sleeve when such a sleeve is present. In the same way the recess 19 may, where the free end 13 of the spring 12 rests in the inactive position, very well consist of a recess in the corresponding sleeve, when such a sleeve is present, instead of a recess in the inner part of the gripping part, which is the illustrated case.

With regard to the form of the spring part 12 it may advantageously be a leaf spring, but also other spring forms are conceivable and the design in detail of the guide means must then be accordingly adapted in an appropriate way by the person skilled in the art. The spring part may be detachably held in the mentioned sleeve or be undetachably held at the mentioned sleeve, for instance glued on place in the sleeve. It is also conceivable that it is made in one piece with the sleeve. This may for instance be achieved by the spring and the sleeve being injection moulded in one and the same tool, in an appropriate material such as for instance acetal plastic or the like. The spring is then formed in such a way that it will sit firmly in the sleeve, i.e. so that the end part of the spring is in one piece with the sleeve. By providing the spring with a particularly thin portion in the proximity of this end part the spring may be bent into different directions and therewith caused to take the different positions in the guides.

In the illustrated examples the spring part is held firmly, via its one end, within the sleeve, but it should be possible within the scope of the inventive concept, i.e. making possible to have a spring that can take both an inactive position and an active position, to also provide this in some other way for example by an arrangement provided on the outside of the sleeve or equivalent.

The invention claimed is:

1. Hand tool comprising a first leg and a second leg, whereby a front part of the respective leg forms a tool part and a rear part of the respective leg forms a gripping part, which gripping part for at least one of the legs comprises an outer part in the form of a sleeve that is fitted over an inner part connected to the tool part, and further comprising at lest one spring part with a first freely moveable end part and a second end part firmly held to the mentioned sleeve, which spring part is intended to again move the legs apart after they have been squeezed together in connection with usage of the tool, characterized in that the mentioned sleeve for one of the mentioned legs is formed with guides for at least two positions for the spring part, of which a first guide defines a first position which is an inactive position for the spring part where it does not exert any separating force upon the legs in use and a second guide defines a second position which is an active position for the spring part where it exerts a separating force upon the legs in use as a result of the first free end part of the spring part coming into abutment with the opposing leg.

2. Hand tool according to claim 1, characterized in that the mentioned sleeve is provided with guides for two or more positions for the spring part, where the spring part exerts a separating force upon the legs in use, and in that the spring part may be moved between these active positions in order to change the maximum opening angle between the legs with the aid of the spring part.

3. Hand tool according to claim 1 in that the mentioned guides are located on the inside of the sleeve, facing the inner part of the gripping part.

4. Hand tool according to claim 3, characterized in that the respective guide is formed as a groove on the inside of the sleeve and that the different positions of the spring part are defined by abutment in the different grooves.

5. Hand tool according to claim 1 characterized in that the spring part is detachably held at the mentioned sleeve.

6. Hand tool according to claim 1 characterized in that the spring part is unreleasably held at the mentioned sleeve.

7. Hand tool according to claim 1 in that the spring part is made in one piece with the mentioned sleeve.

8. Hand tool according to claim 1 in that the leg which is opposite to the leg provided with the sleeve comprising guides, comprises a recess in which the free end part of the spring part may move freely when the spring part takes its inactive position in the sleeve.

* * * * *